US011685024B2

(12) United States Patent
Chang

(10) Patent No.: US 11,685,024 B2
(45) Date of Patent: Jun. 27, 2023

(54) WRENCH

(71) Applicant: Wen-Chien Chang, Taichung (TW)

(72) Inventor: Chi-Fong Chang, Taichung (TW)

(73) Assignee: Wen-Chien Chang, Taichung (TW)

( * ) Notice: Subject to any disclaimer, the term of this patent is extended or adjusted under 35 U.S.C. 154(b) by 258 days.

(21) Appl. No.: 17/245,386

(22) Filed: Apr. 30, 2021

(65) Prior Publication Data

US 2022/0126423 A1 Apr. 28, 2022

(30) Foreign Application Priority Data

Oct. 28, 2020 (TW) ..... 109137457

(51) Int. Cl.
*B25B 23/00* (2006.01)
*B25B 13/02* (2006.01)

(52) U.S. Cl.
CPC ..... *B25B 13/02* (2013.01); *B25B 23/0028* (2013.01)

(58) Field of Classification Search
CPC ..... B25B 23/16; B25B 23/0028; B25G 1/066; B25G 3/38; Y10T 403/32614; Y10T 403/32754
USPC ..... 403/146, 147, 163
See application file for complete search history.

(56) References Cited

U.S. PATENT DOCUMENTS 2,977,824 A * 4/1961 Rueb ..... B25B 23/16 72/368
2019/0091841 A1* 3/2019 Chen ..... B25B 13/461
2019/0152026 A1* 5/2019 Hyust ..... B25B 23/0028

* cited by examiner

*Primary Examiner* — Bryan R Muller
(74) *Attorney, Agent, or Firm* — Muncy, Geissler, Olds & Lowe, P.C.

(57) ABSTRACT

A wrench is provided, including: a connection seat, including two seat bodies and a connection portion, the two seat bodies respectively including two first pivot portions; and a driving member, movably connected with the connection seat, the driving member including two second pivot portions, and the two second pivot portions being rotatably connected with the two first pivot portions.

10 Claims, 5 Drawing Sheets

WRENCH

BACKGROUND OF THE INVENTION

Field of the Invention

The present invention relates to a wrench.

Description of the Prior Art

Conventional wrench includes a handle and a work head, and the handle and the work head are connected with each other by a screw. The work head is rotatable about the screw as a rotation axis relative to the handle, and the handle and the work head are respectively destroyed by drilling a hole or tapping. When a screwing member, such as a bolt, a screw, a threaded rod, is assembled to or dissembled from the handle or the work head, the screwing member concentrates stress respectively on a hole of the handle and a hole of the work head by a torsional force. It is easy to cause the screwing member to collapse or break.

The present invention is, therefore, arisen to obviate or at least mitigate the above mentioned disadvantages.

SUMMARY OF THE INVENTION

An object of the present invention is to provide a wrench with an original structure and high structural strength.

To achieve the above and other objects, a wrench is provided, including: a connection seat, including two seat bodies and a connection portion, the two seat bodies respectively including a first assembling portion and two first pivot portions, the first assembling portion of each said seat body including a connection space having an opening and at least one arm portion defining at least part of the connection space, the two first pivot portions of respective one of the two seat bodies disposed on the at least one arm portion of the respective one of the two seat bodies, the connection portion connected with at least one of the two seat bodies, the connection portion being configured to be connected with a rod member; and a driving member, movably connected with the connection seat, including a work portion and a second assembling portion, the second assembling portion connected with the work portion, the second assembling portion including a base portion and two second pivot portions, the base portion movably disposed within the connection space, the two second pivot portions respectively disposed on opposite sides of the base portion, the two second pivot portions being rotatably connected with the two first pivot portions.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
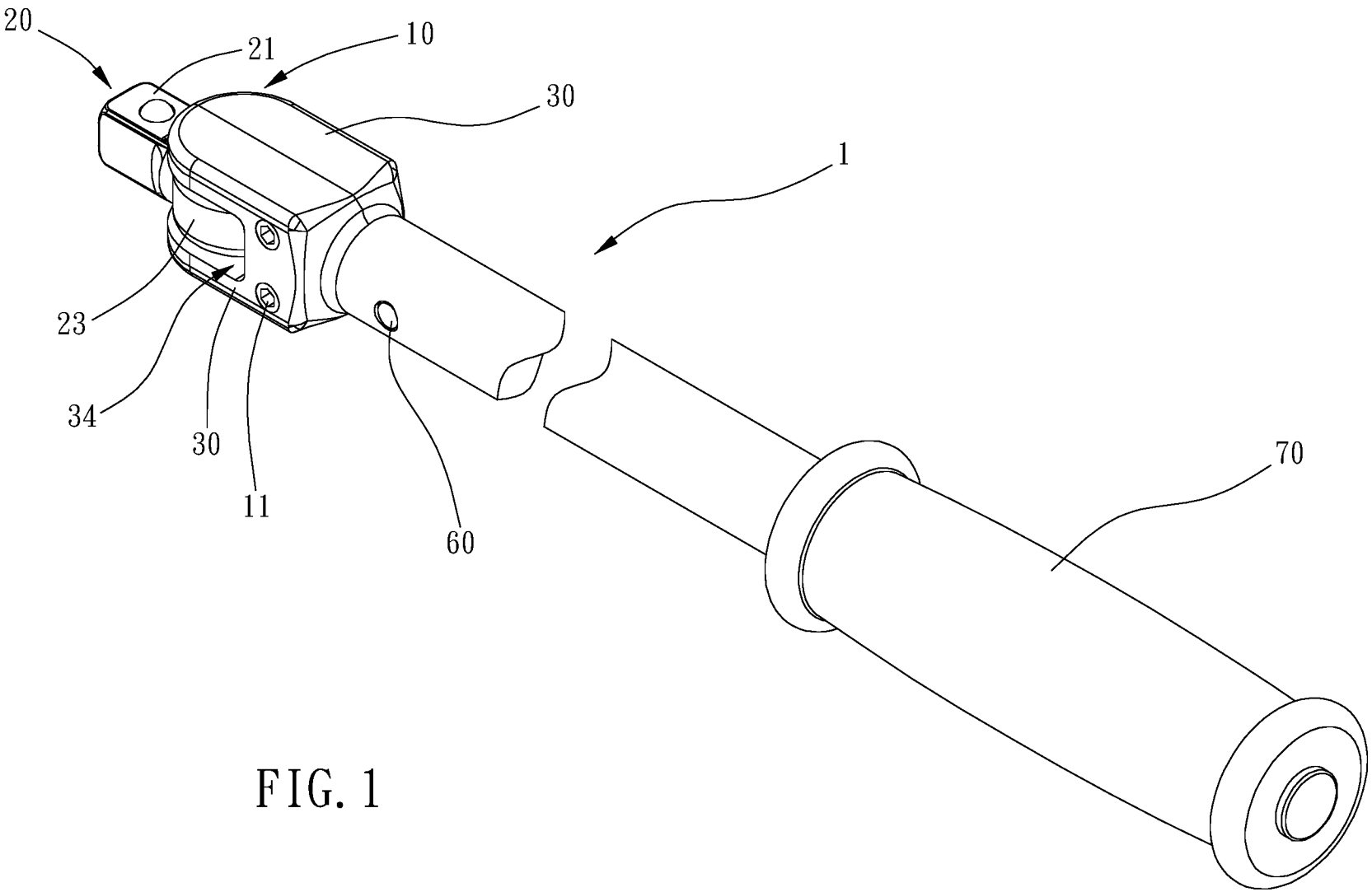
FIG. 1 is a perspective view of a preferred embodiment of the present invention.
Figure 2:
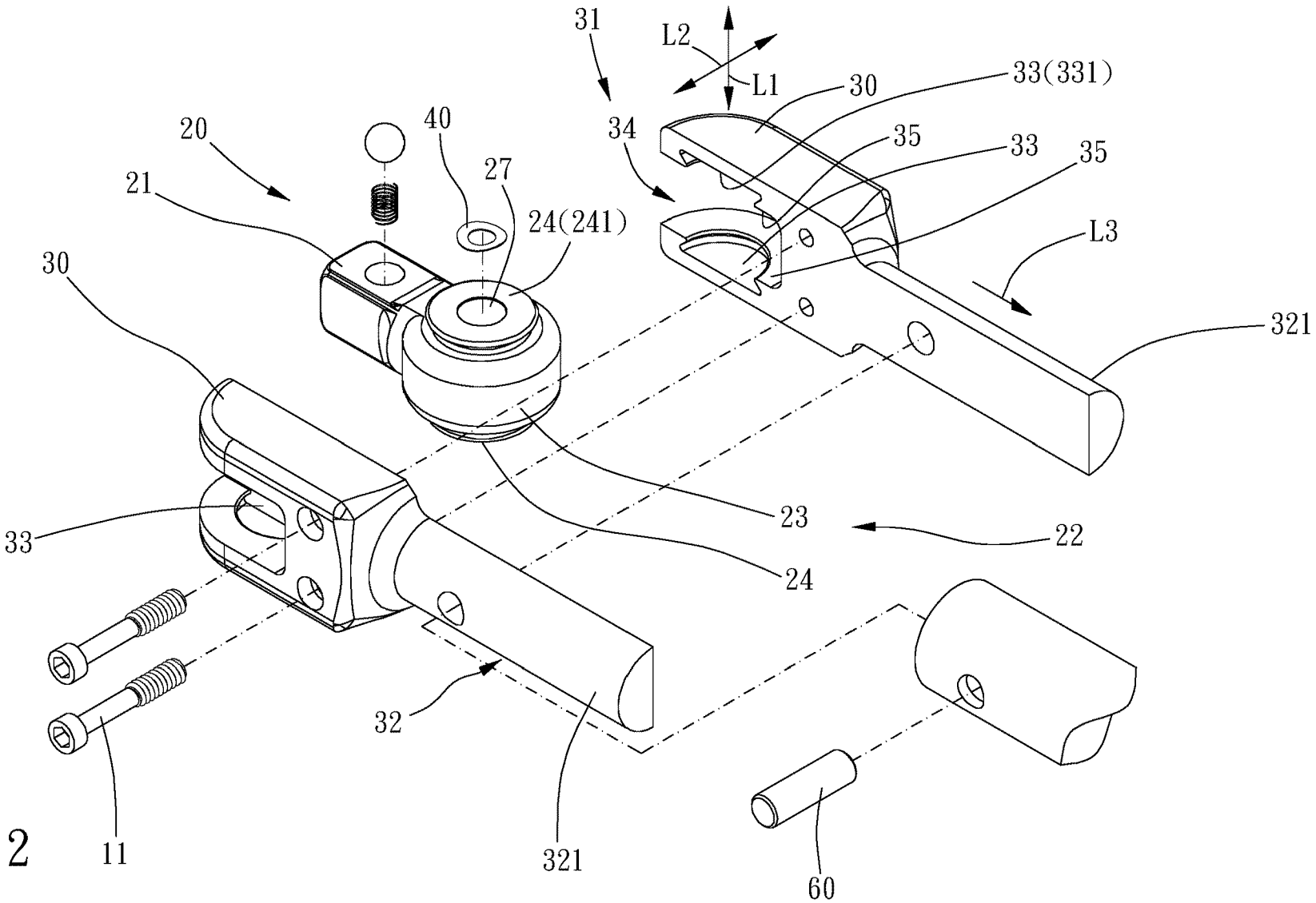
FIG. 2 is a breakdown drawing of a preferable embodiment of the present invention.
Figure 3:
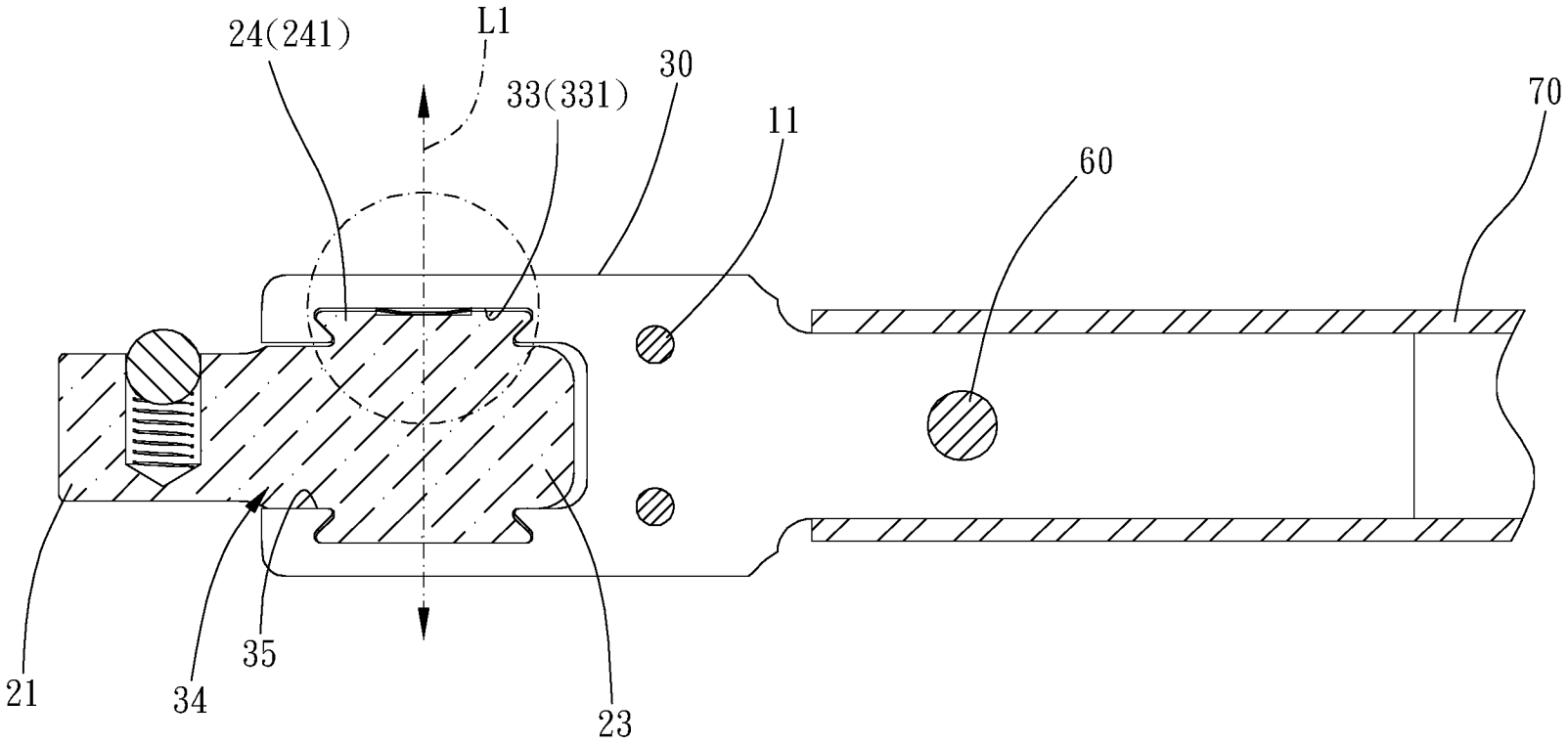
FIG. 3 is a cross-sectional view of a preferable embodiment of the present invention.
Figure 4:
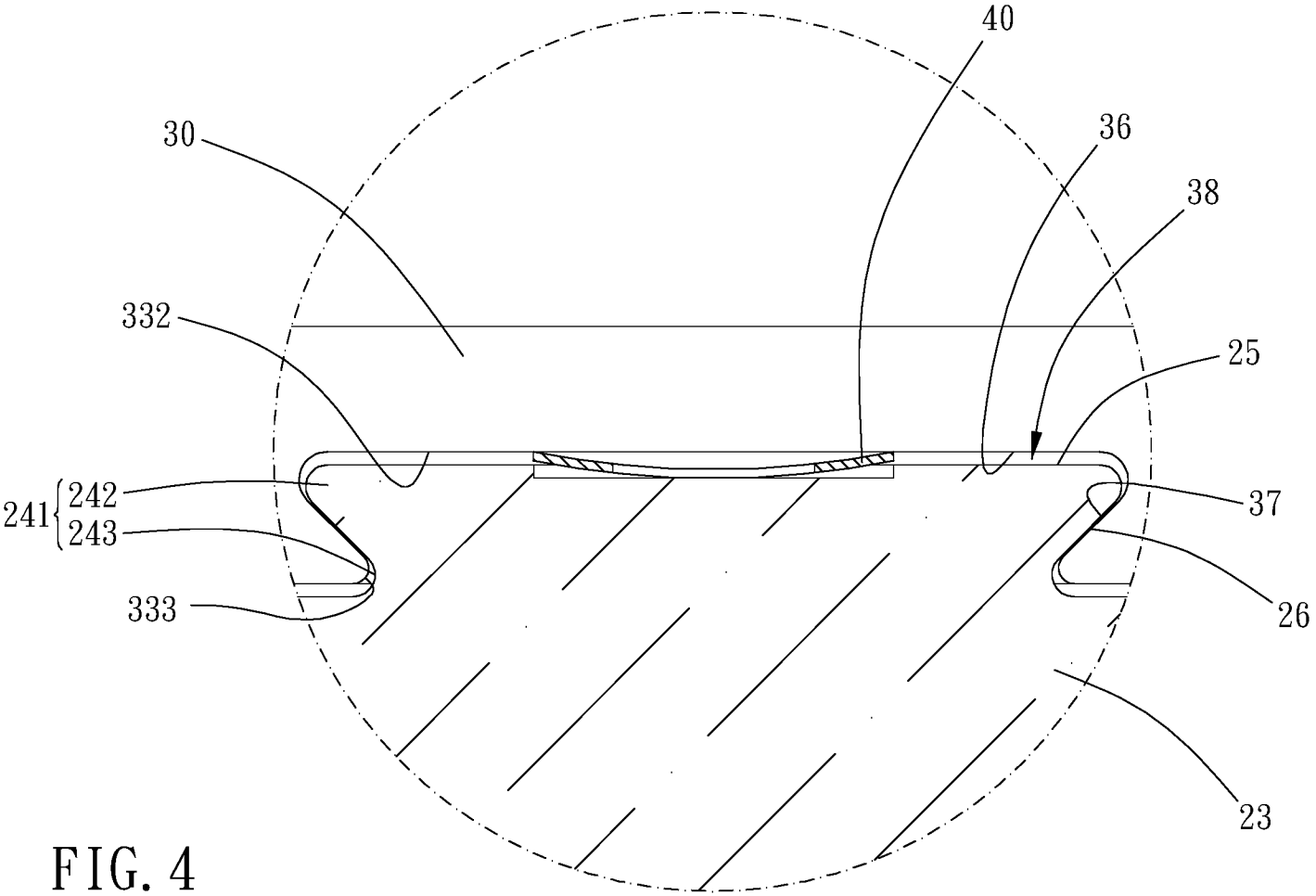
FIG. 4 is a partially-enlarged view of FIG. 3.
Figure 5:
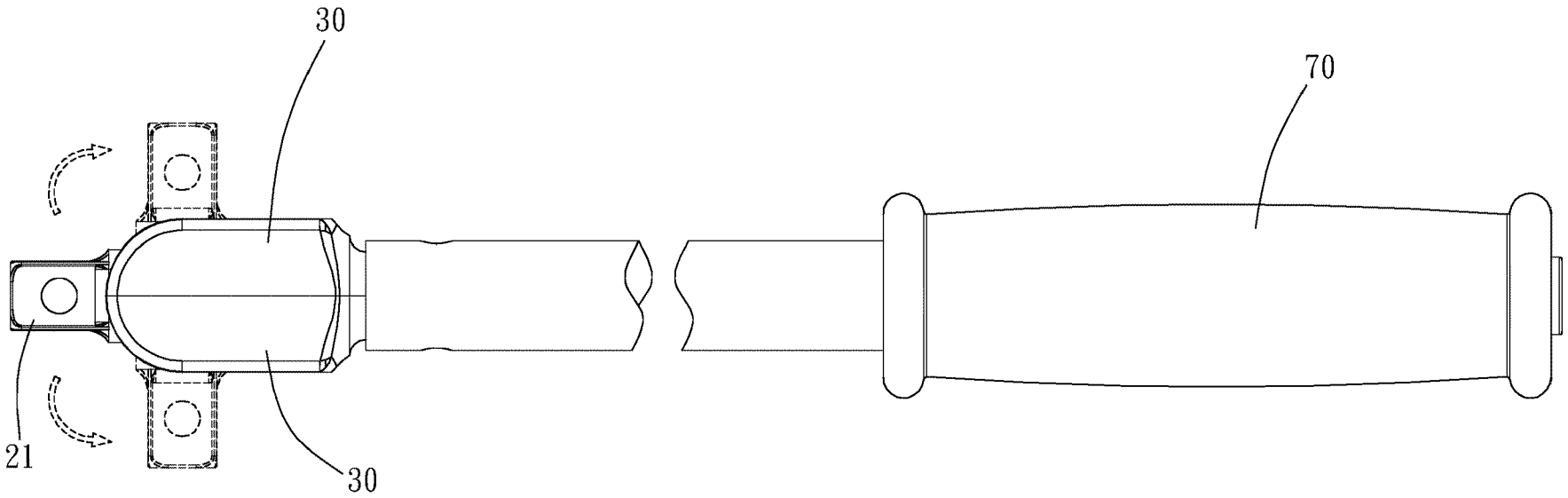
FIG. 5 is a drawing showing a preferable embodiment of the present invention; in use.

FIGS. 1 to 5 show a wrench according to a preferred embodiment of the present invention. The wrench 1 includes a connection seat 10 and a driving member 20.

The connection seat 10 includes two seat bodies 30 and a connection portion 32. The two seat bodies 30 respectively includes a first assembling portion 31 and two first pivot portions 33, the first assembling portion 31 of each said seat body 30 includes a connection space 34 having an opening and at least one arm portion 35 defining at least part of the connection space 34. The two first pivot portions 33 of respective one of the two seat bodies 30 is disposed on the at least one arm portion 35 of the respective one of the two seat bodies 30, the connection portion 32 is connected with at least one of the two seat bodies 30, and the connection portion 32 is configured to be connected with a rod member 70. The driving member 20 is movably connected with the connection seat 10. Specifically, the driving member 20 is rotatably or swingably connected with the connection seat 10. The driving member 20 includes a work portion 21 and a second assembling portion 22. The second assembling portion 22 is connected with work portion 21. The second assembling portion 22 includes a base portion 23 and two second pivot portions 24. The base portion 23 is movably disposed within the connection space 34, the two second pivot portions 24 are respectively disposed on opposite sides of the base portion 23, and the two second pivot portions 24 are rotatably connected with the two first pivot portions 33. Respectively one of each said first pivot portion 33 of the two seat bodies 30 and each said second pivot portion 24 is a first engagement portion, the other of each of the two first pivot portions 33 of the two seat bodies 30 and each of the two second pivot portions 24 is a second engagement portion which is rotatably connected with the first engagement portion. The two first pivot portions 33 of each said seat body 30 are integrally formed on the at least one arm portion 35, each of the two second pivot portions 24 is integrally formed on the base portion 23. Thus, the two seat bodies 30 can easily be assembled to or disassembled from the driving member 20. Moreover, the connection seat 10 and the driving member 20 respectively contain an original structure to have a high structural strength. In this embodiment, the two seat bodies 30, the first assembling portion 31 of the two seat bodies 30, and the first pivot portions 33 of the two seat bodies 30 respectively are two half independent parts formed in substantially the same size and connected with each other, and also can be two parts formed in different sizes or shapes.

Each said first engagement portion includes a recess 331, and each said second engagement portion includes a convex portion 241 rotatably engaged within the recess 331. Each said first pivot portion 33 is the first engagement portion, the second pivot portion 24 of the driving member 20 is a second engagement portion. Each said recess 331 of each said seat body 30 opens toward a first direction L1 and a second direction L2 which is transverse to the first direction L1, and each said recess 331 of one of the two seat bodies 30 is communicated with one said recess 331 of the other of the two seat bodies 30. The two seat bodies 30 are disassembly connected with each other in the second direction L2, each said first engagement portion of each said seat body 30 and one said second engagement portions are engaged with each other in the first direction L1, so as to quick assemble and disassemble between the connection seat 10 and the driving member 20. Furthermore, each said arm portion 35 will not be expanded and deformed. The connection seat 10 further includes at least one connection member 11, and each said connection member 11 is disengagably disposed through the two seat bodies 30 in the second direction L2 and adjacent to the first assembling portion 31. The connection seat 10 includes a plurality of said connection members 11, each said connection member 11 is a thread member, so that each said connection member 11 and the two seat bodies 30 are in strong connection and not easy to loosen.

Each said convex portion 241 includes an expanding section 242 and a necking section 243. The expanding section 242 and the necking section 243 are respectively arranged in a first direction L1. An external diameter size of the necking section 243 is less than an external diameter size of an expanding section 242. Each recess 331 includes a large-diameter section 332 and a small-diameter section 333, and an inner diameter size of the small-diameter section 333 is less than an inner diameter size of the large-diameter section 332. The expanding section 242 is engaged within the large-diameter section 332, and the necking section 243 is disposed within the small-diameter section 333. The convex portion 241 and the recess 331 are respectively a dovetail structure or a T-shaped structure and correspond to each other. The expanding section 242 is tapered toward the necking section 243 in the first direction L1, and the large-diameter section 332 is tapered toward the small-diameter section 333 in the first direction L1, so as to be engaged with each other. The expanding section 242 of each said convex portion 241 has a first end surface 25 disposed in the first direction first direction L1 and a first inclined peripheral surface 26 extending around the first direction L1, and the large-diameter section 332 of each said recess 331 has a second end surface 36 disposed in the first end surface 25 and a second inclined peripheral surface 37 extending around the first direction L1. The second inclined peripheral surface 37 is abutted the first inclined peripheral surface 26, and the first end surface 25 and the second end surface 36 define a gap 38 therebetween. In operation, each said arm portion 35 can be hooked inwardly to prevent from being pushed outwardly. Furthermore, it can be distributed force by a large contact area of the second inclined peripheral surface 37 and the first inclined peripheral surface 26 to reduce stress concentration and provide smooth rotation.

The wrench 1 further includes a washer 40, and the washer 40 is abutted against and between one of the two second pivot portions 24 and one of the two first pivot portions 33 of the two said seat bodies 30. One said second engagement portion has a concave 27, and the washer 40 is disposed within the concave 27. The washer 40 is a bended washer, so as to easy assemble and disassemble. Furthermore, when the bended washer is pressed and deformed, the bended washer has a sufficient force to bias between one of the two second pivot portions 24 and one of the two first pivot portions 33 of the two said seat bodies 30. Thus, it can increase friction between the driving member 20 and the connection seat 10, so that the driving member 20 can be positionably continuously rotated relatively to the connection seat 10.

The connection portion 32 includes two connection rods 321, each said seat body 30 is connected with one said connection rod 32, each said connection rod 321 extends in a third direction L3, and the third direction L3 is transverse to the first direction L1 and the second direction L2. The wrench 1 further includes a pin 60 and the rod member 70. The connection portion 32 of the two seat bodies 30 is disassembly connected with the rod member 70, the pin 60 is disassembly disposed through each said connection portion 32 and the rod member 70 for quick assembly and disassembly. The connection portion 32 can be connected with one said seat body 30 or both two said seat bodies 30. For example, the two connection rods 321 are respectively connected with the two seat bodies 30. Specifically, the two connection rods 321 are two half parts formed in substantially the same size and connected with each other, and also can be two parts formed in different sizes or shapes.

Each said seat body 30 includes two said arm portions 35 disposed separately, the two arm portions 35 define at least part of the connection space 34, and each of the two first pivot portions 33 of each said seat body 30 is disposed on one of the two arm portions 35 of each said seat body. Preferably, each of the two first pivot portions 33 of the two seat bodies 30 are respectively disengagably engaged with opposite sides of one said second pivot portions 24, so as to quick assemble and disassemble, and also provide strong connection. Each said second pivot portion 24 distributes the force on the two seat bodies 30.

The base portion 23 includes two lateral end surfaces disposed on opposite sides thereof in the first direction L1 and a circumferential surface. The circumferential surface is connected between the two lateral end surfaces, and each said second pivot portion 24 disposed on one said lateral end surface. The work portion 21 radially disposed on the circumferential surface, so as to have a strong structural strength.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wrench, including:

a connection seat, including two seat bodies and a connection portion, the two seat bodies respectively including a first assembling portion and two first pivot portions, the first assembling portion of each said seat body including a connection space having an opening and at least one arm portion defining at least part of the connection space, the two first pivot portions of respective one of the two seat bodies disposed on the at least one arm portion of the respective one of the two seat bodies, the connection portion connected with at least one of the two seat bodies, the connection portion being configured to be connected with a rod member; and a driving member, movably connected with the connection seat, including a work portion and a second assembling portion, the second assembling portion connected with the work portion, the second assembling portion including a base portion and two second pivot portions, the base portion movably disposed within the connection space, the two second pivot portions respectively disposed on opposite sides of the base portion, the two second pivot portions being rotatably connected with the respective two first pivot portions.

2. The wrench of claim 1, wherein respectively one of each said first pivot portion of the two seat bodies and each said second pivot portion is a first engagement portion, the other of each of the two first pivot portions of the two seat bodies and each of the two second pivot portions is a second engagement portion which is rotatably connected with the first engagement portion, the two first pivot portions of each said seat body are integrally formed on the at least one arm portion, each of the two second pivot portions is integrally formed on the base portion, each said first engagement portion includes a recess, and each said second engagement portion includes a convex portion rotatably engaged within the recess.

3. The wrench of claim 2, wherein each said first pivot portions is the first engagement portion, each said recess of each said seat body opens toward a first direction and a second direction which is transverse to the first direction, and each said recess of one of the two seat bodies is communicated with one said recess of the other of the two seat bodies.

4. The wrench of claim 2, wherein each said convex portion includes an expanding section and a necking section, the expanded section and the necking section are respectively arranged in a first direction, an external diameter size of the necking section is less than an external diameter size of the expanded section, each said recess includes a large-diameter section and a small-diameter section, an inner diameter size of the small-diameter section is less than an inner diameter size of the large-diameter section, the expanding section is engaged within the large-diameter section, and the necking section is disposed within the small-diameter section.

5. The wrench of claim 4, wherein the expanding section is tapered toward the necking section in the first direction, and the large-diameter section is tapered toward the small-diameter section in the first direction.

6. The wrench of claim 3, wherein the two seat bodies are removably connected with each other in the second direction, each said first engagement portion of each said seat body and one said second engagement portions are engaged with each other in the first direction; and the connection seat further includes at least one connection member, and each said connection member is disengagably disposed through the two seat bodies in the second direction.

7. The wrench of claim 1, further including a washer, the washer abutted against and between one of the two second pivot portions and one of the two first pivot portions of the two said seat bodies.

8. The wrench of claim 7, wherein one said second engagement portion has a concave, and the washer is disposed within the concave.

9. The wrench of claim 1, wherein each of the two seat bodies includes two said arm portions disposed separately, the two arm portions define at least part of the connection space, and each of the two first pivot portions of each said seat body is disposed on one of the two arm portions of each said seat body.

10. The wrench of claim 5, wherein each said first pivot portions is the first engagement portion, each said recess of each said seat body opens toward a first direction and a second direction which is transverse to the first direction, and each said recess of one of the two seat bodies is communicated with one said recess of the other of the two seat bodies; the two seat bodies are disassembly connected with each other in the second direction, each said first engagement portion of each said seat body and one said second engagement portions are engaged with each other in the first direction; and the connection seat further includes at least one connection member, and each said connection member is disengagably disposed through the two seat bodies in the second direction; the wrench further including a washer, the washer abutted against and between one of the two second pivot portions and one of the two first pivot portions of the two said seat bodies; wherein the washer is a bended washer; one said second engagement portion has a concave, and the washer is disposed within the concave; the expanding section of each said convex portion has a first end surface disposed in the first direction and a first inclined peripheral surface extending around the first direction, the large-diameter section of each said recess has a second end surface disposed in the first end surface and a second inclined peripheral surface extending around the first direction, the second inclined peripheral surface is abutted the first inclined peripheral surface; the connection portion includes two connection rods, each seat bodies is connected with one said connection rod, each said connection rod extends in a third direction, the third direction is transverse to the first direction and the second direction; each said seat body includes two said arm portions disposed separately, the two arm portions define at least part of the connection space, and each of the two first pivot portions of each said seat body is disposed on one of the two arm portions of each said seat body; each of the two first pivot portions of the two seat bodies are respectively disengagably engaged with opposite sides of one said second pivot portions.

* * * * *